US006036236A

United States Patent [19]

Bensel

[11] Patent Number: 6,036,236

[45] Date of Patent: Mar. 14, 2000

[54] HEAT EXCHANGER WITH LOCKING CONNECTOR

[75] Inventor: Thomas Bensel, Ditzingen, Germany

[73] Assignee: Behr GmbH & Co., Stuttgart, Germany

[21] Appl. No.: 08/993,014

[22] Filed: Dec. 18, 1997

[30] Foreign Application Priority Data

Dec. 18, 1996 [DE] Germany ..... 196 52 639

[51] Int. Cl.[7] ..... F16L 15/00

[52] U.S. Cl. ..... 285/89; 411/145; 411/330; 411/953; 285/81

[58] Field of Search ..... 285/89, 81; 411/7, 411/119, 128, 138, 141, 145, 329, 330, 331, 953

[56] References Cited

U.S. PATENT DOCUMENTS

| | | | |
|---|---|---|---|
| Re. 35,937 | 10/1998 | DiStasio | 411/7 |
| 750,130 | 1/1904 | Smith | 411/953 |
| 969,397 | 9/1910 | Partridge | 411/128 |
| 1,714,711 | 5/1929 | Elkin | 411/953 |
| 3,608,933 | 9/1971 | Lee | 285/89 |
| 3,804,140 | 4/1974 | Harper | 411/119 |
| 4,030,798 | 6/1977 | Paoli | 411/331 |
| 4,094,358 | 6/1978 | Neveux | 165/154 |
| 5,481,938 | 1/1996 | Stuedemann et al. | 411/330 |

FOREIGN PATENT DOCUMENTS

| | | |
|---|---|---|
| 69800 | 9/1915 | Austria . |
| 0 357 602 B1 | 5/1992 | European Pat. Off. . |
| 26 12 416 A1 | 10/1976 | Germany . |
| 36 00 957 | 10/1986 | Germany . |
| 39 35 753 | 5/1990 | Germany . |
| 44 43 171 | 6/1996 | Germany . |

*Primary Examiner*—Eric K. Nicholson
*Attorney, Agent, or Firm*—Foley & Lardner

[57] ABSTRACT

A heat exchanger, particularly with an integrated oil heat exchanger, has screw-in connectors. Each connector is secured to the exchanger using a retaining ring, which has finger forming projections. The heat exchanger has an annular collar with circumferentially spaced teeth on its inner circle. The fingers engage the teeth. The fingers and the teeth are arranged to prevent the connector from being unintentionally unscrewed or loosened by virtue of the connector being secured by the retaining ring.

15 Claims, 3 Drawing Sheets

HEAT EXCHANGER WITH LOCKING CONNECTOR

BACKGROUND OF THE INVENTION

A heat exchanger, such as a water heat exchanger or oil heat exchanger uses a liquid or a gas cooling medium. A typical heat exchanger has at least one inlet connector and at least one outlet connector communicating the medium to be cooled to and from the exchanger.

EP 357,602 B1, for example, discloses this type of a heat exchanger, where both the inlet connector and the outlet connector are screwed into a socket located in the heat exchanger. By tightening the connector, a leakproof connection can be made between the connector and the radiator housing. It has been shown, however, that, particularly because of temperature fluctuations and vibrations, the connector can loosen.

DE-A 26 12 416 discloses another heat exchanger where the connector is sealingly connected to the radiator housing by means of gasket elements. Here too, there is the risk of the threaded connection being loosened. In particular, because the gasket is elastomeric, it is not possible for the connector to be screwed-in with a defined tightening torque.

Thus, there is a need for a heat exchanger with a screw-in connector that provides a reliable connection, without the aforementioned drawbacks. The present invention meets this need.

SUMMARY OF THE INVENTION

A heat exchanger according to the invention comprises at least one connector and a retaining washer. The connector can be an inlet or outlet for communicating fluid or gas to or from the exchanger. For connecting to the heat exchanger, the connector has a threaded portion. The connector can be connected to the heat exchanger by rotating the same in one (screw-in) direction. The retaining washer has an opening through which the connector engages the retaining washer. The retaining washer is non-rotatably connected to the connector.

The retaining washer has first projections. Second projections are formed in the heat exchanger. The first projections engage the second projections and cooperate together to resist against or prevent the retainer washer, and thus the connector, from rotating in the opposite (unscrewing) direction, which loosens the connector from the heat exchanger. This prevents the connector from being unintentionally loosened.

According to further aspects of the invention, the heat exchanger has a tank having a wall and an opening through the wall. An annular collar can extend, concentrically with the opening, from an outer surface of the wall. The retaining washer is positioned substantially concentrically within the annular collar and engages an outer surface of the wall. The threaded portion of the connector is inserted through the opening of the retaining washer and the opening of the wall. A nut is provided to receive the threaded portion so that the connector is secured to the wall by rotating the same in the one direction. The nut can be secured to the wall so that it does not rotate relative to the wall.

The annular collar has second projections that can engage the first projections. The first and second projections are arranged to permit the retaining washer to rotate, substantially unhampered, in the one direction and prevent unintentional rotation in the opposite direction.

The annular collar preferably is integrally formed on the outer surface of the heat exchanger to surround the retaining washer. The second projections are preferably provided on the annular collar. The second projections are also preferably spaced evenly around the annular collar.

According to further aspects of the invention, the heat exchanger has at least one inlet connector and at least one outlet connector, each connected to the heat exchanger in the same manner.

According to another aspect of the invention, each connector has a peripheral collar adjacent to the threaded portion. The retaining washer is positioned between the outer surface of the heat exchanger and the peripheral collar.

According to another aspect of the invention, the connector has a portion (e.g., the peripheral collar), with a hexagonal geometry and the retaining washer has a complementary hexagonal recess engaging the hexagonal portion to provide a non-rotational connection between the connector and the retaining washer. The recess can have a bearing face engaging the hexagonal collar.

Each first projection can be formed by a finger extending outwardly at an angle toward the opposite (unscrewing) direction, the finger being elastically deflectable in the radial direction. Specifically, the first projections extend or project outwardly radially and tangentially toward the one direction.

The second projections can be saw-tooth shaped. That is, each second projection can have a radially extending portion and a sloped portion, each sloped portion connecting two adjacent radially extending portions, from a radial outer end to a radial inner end. Specifically, the sloped portion connects one end of one radially extending portion and another end of an adjacent radially extending portion. Each finger can abut one of the radially extending portion to prevent the retaining washer from rotating in the opposite direction.

According to another aspect of the invention, the first projections are divided into two groups. Each projection of one group is positioned alternatingly between two adjacent projections of the other group. The angular spacing between the first projections within the group relative to the first projections of the other group is identical. The angular spacing, however, between any one of the first projections and one of the two first projections adjacent to the one projection is different from the angular spacing between the one first projection and the other of the two adjacent first projections.

According to another aspect of the invention, the retaining washer is integrally formed with the connector.

The diameter formed by the first projections is preferably greater than the diameter formed by a base circle of the second projections. Each connector also can have a circumferential groove into which the retaining ring can be engaged to form a preassembly.

BRIEF DESCRIPTION OF THE DRAWINGS

These and other features, aspects, and advantages of the present invention will become more apparent from the following description, appended claims, and accompanying preferred exemplary embodiments shown in the drawings, which are briefly described below.

DETAILED DESCRIPTION OF THE PREFERRED EMBODIMENT

Figure 1:
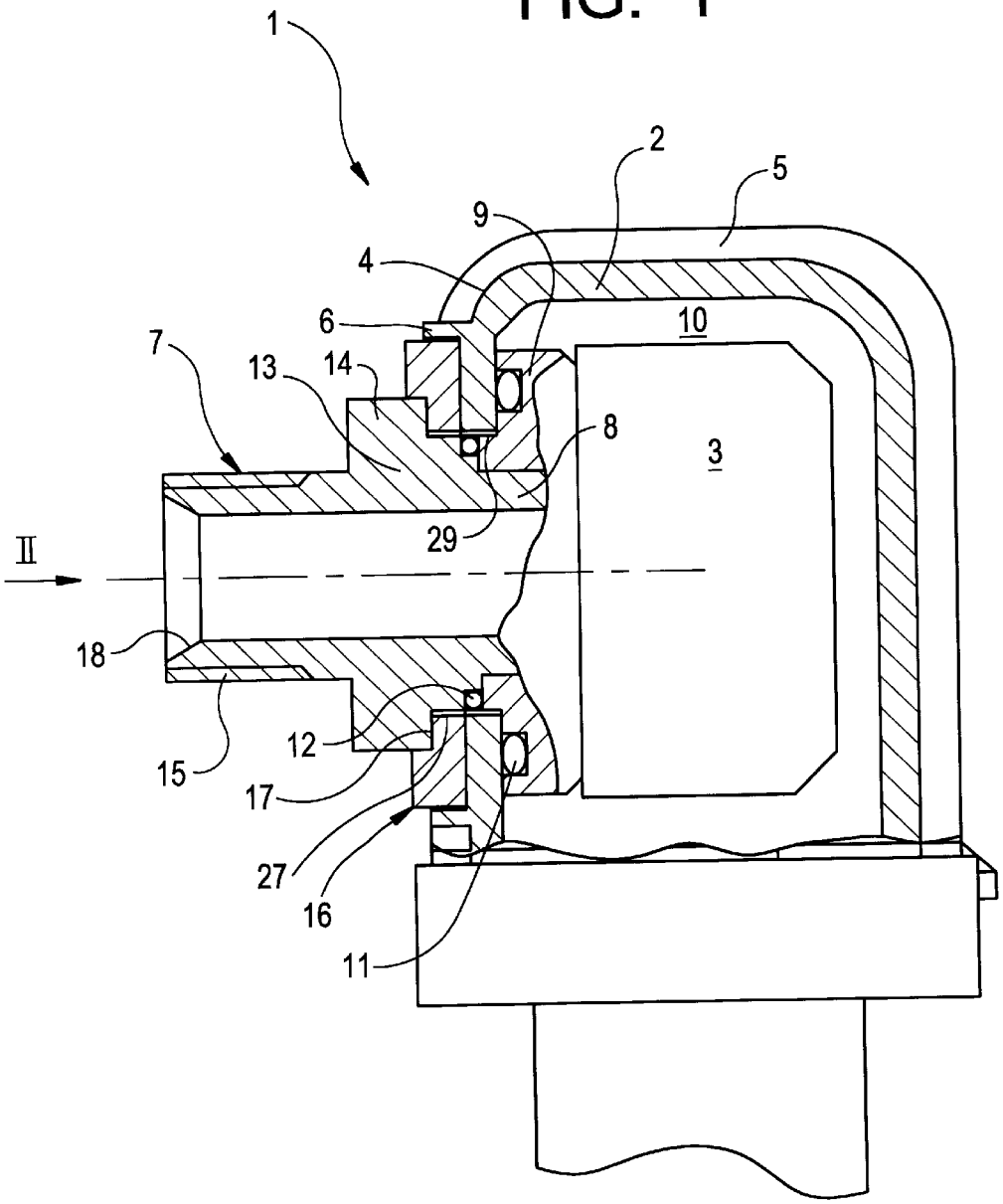
FIG. 1 shows a cross-section through a connector screwed into a heat exchanger according to the invention.

FIG. 1 illustrates a portion of a heat exchanger 1 according to the invention. The exchanger 1 has a water box or tank 2 containing another heat exchanger 3, such as for cooling oil. The tank 2 is provided on its outer surface 4 with stiffening ribs 5 and with an annular collar 6 projecting from the surface defined by a wall forming the tank. The collar 6 is preferably integrally formed with the tank, i.e., the wall. A connector 7, which can be for either an inlet or outlet, for the oil heat exchanger 3, for example, is screwed or threaded into the tank 2, with the connector coaxially arranged relative to the collar 6. For this purpose, the connector 7 possesses a fastening stub or a threaded portion 8 provided with an external thread, which is screwed into a corresponding nut 9 provided with an internal thread. The nut 9 can be positioned so that it does not rotate relative to the wall.

A leakproof closure between the interior 10 of the tank 2 and the surroundings is provided by an O-ring 11, which is inserted into an annular groove formed on the nut 9. The O-ring 11 bears sealingly on the inner surface (the wall) of the tank 2. A leakproof connection between the connector 7 and the nut 9 is made by another O-ring 12, which is provided between the connector 7 and the nut 9, in the region of the opening or through-passage of the tank.

Figure 2:
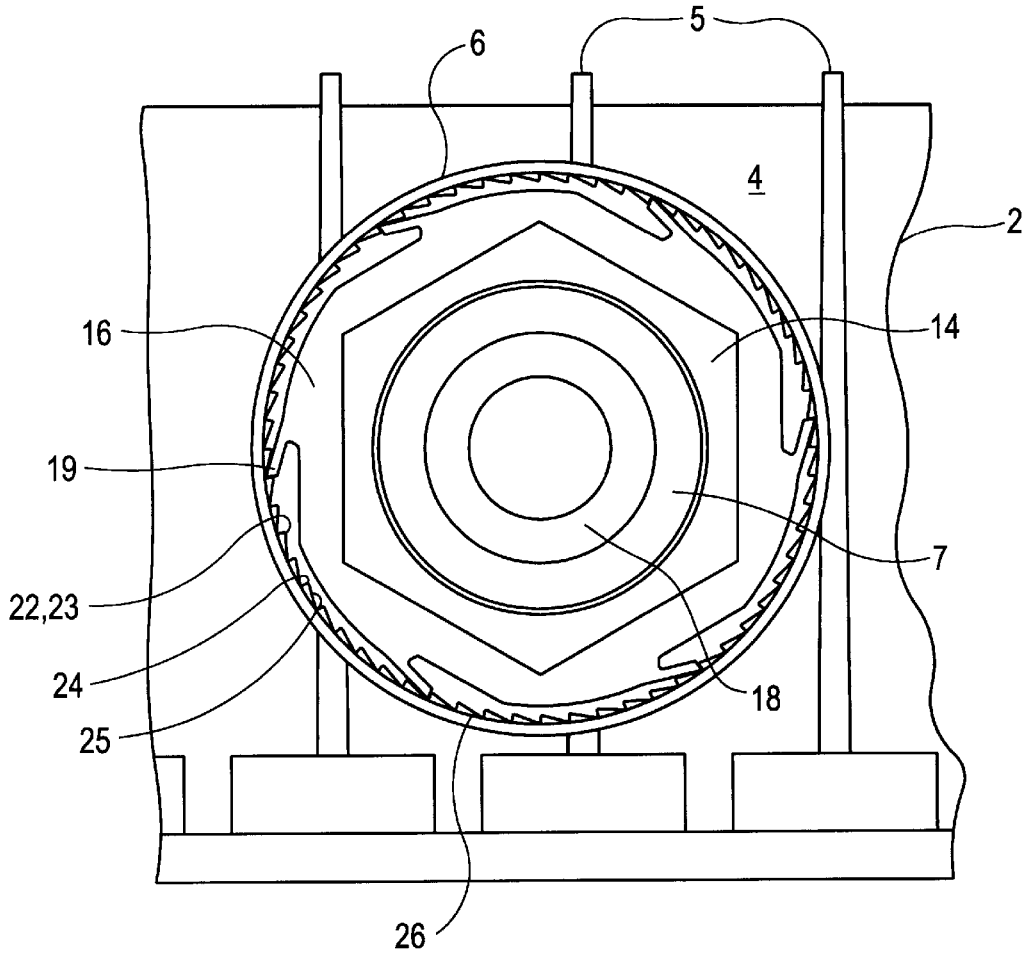
FIG. 2 shows a top view of the connector in the direction of the arrow II of FIG. 1.
Figure 4:
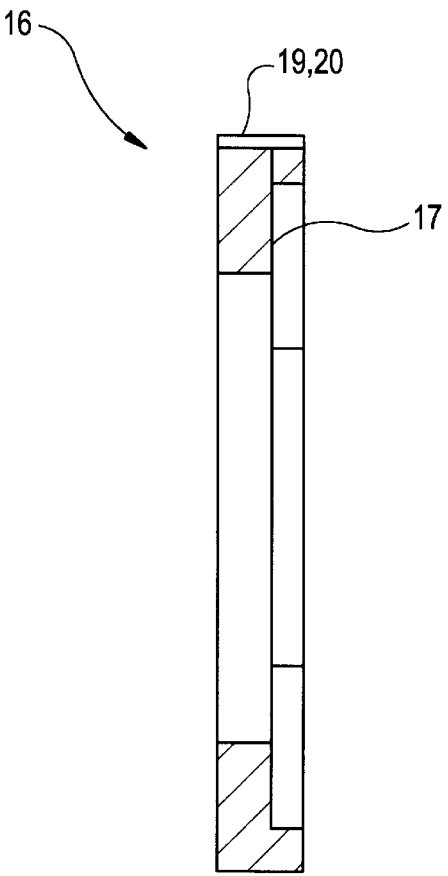
FIG. 4 shows a cross-section of the retaining washer taken along the line IV—IV of FIG. 3.

It can also be seen in FIGS. 1 and 2 that the connector 7 is provided with a peripheral collar 13 having a hexagonal portion 14. The free end of the connector 7 is provided with an external thread 15, onto which a union nut (not illustrated) of a connecting line can be screwed. Moreover, the free end of the connector 7 has a sealing cone 18 for the line to be seated.

Figure 3:
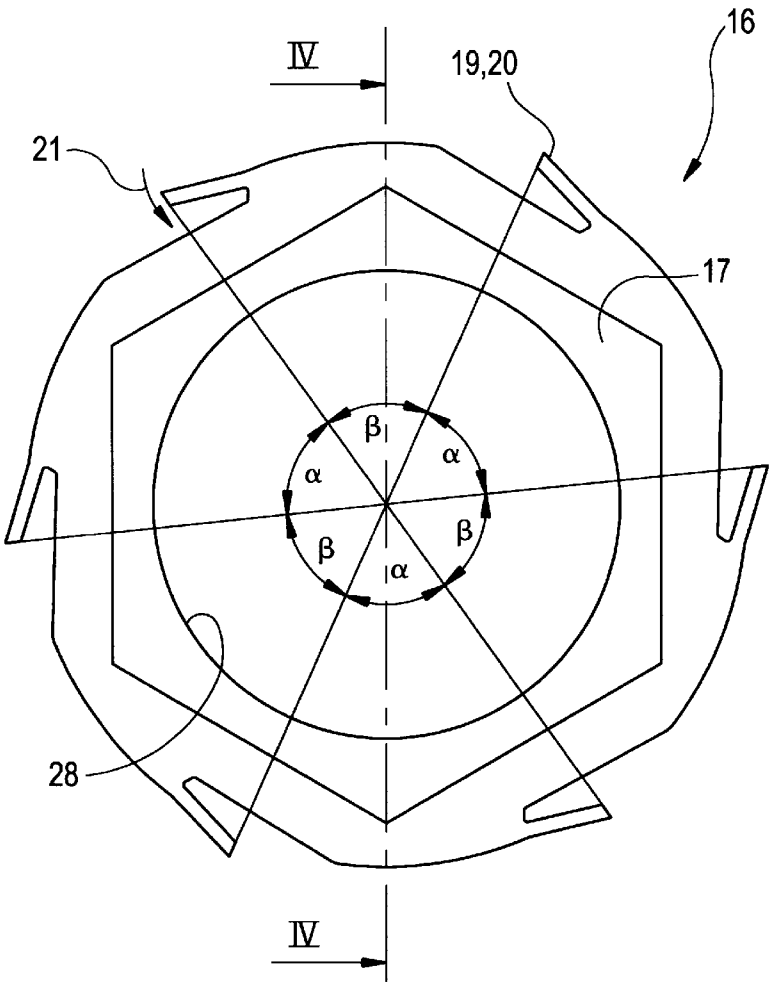
FIG. 3 shows a top view of the retaining washer.

A retaining washer 16, which is illustrated in detail in FIG. 3, is located between or sandwiched between the collar 13 of the connector 7 and the outer surface 4 of the tank 2. The retaining washer 16 is provided with a hexagonal recess 17, into which the hexagonal portion 14 comes to rest. The retaining washer 16 itself rests against the outer surface of the tank 2, within the collar 6 of the tank 2. When the connector 7 is being screwed into the holding element 9, the retaining washer 16 is taken up by the hexagonal portion 14 and, within the collar 6, is pressed onto the outer surface 4 of the tank 2. The hexagonal recess 17 of the retaining washer 16 and the hexagonal portion 14 of the connector 7 form a rotationally fixed connection. Moreover, the collar 13 of the connector 7 has an indentation 27, into which the retaining washer 16 can be snapped into or engaged with its radially inner circumferential edge. See FIG. 3. The connector 7 and the washer 16 can be fitted together to form a preassembly.

FIG. 2 illustrates the hexagonal portion 14 of the connector 7 inserted into the hexagonal recess 17. It can easily be seen that, when the connector 7 is being screwed into the tank 2, the retaining washer 16 is taken up. As illustrated in FIG. 3, this retaining washer has fingers 19 that project outwardly, substantially radially and tangentially from its outer circumference. These fingers 19, which form the first projections 20, are preferably elastically pivotal radially inward in the direction of the arrow 21. See. FIG. 3. Since the fingers 19 are designed to be radially inwardly resilient, existing tolerances at the tank 2 can be compensated. Thus, for example, the opening or orifice 29 (see FIG. 1) of the tank 2 receiving the fastening stub 8 may be oversized to some extent. Furthermore, the fingers 19 project or extend essentially tangentially from the circumference of the retaining washer 16 opposite to the screw-in direction of the connector 7.

Uniform force distribution over the circumference of the retaining washer 16 is achieved by arranging altogether six fingers 19, for example. It can be seen from FIG. 2 that the inner circumference of the collar 6 is provided with a toothing 22 formed by second projections 23. The toothing 22 is saw-tooth shaped, with a first portion 24 running substantially radially and a second portion 25 running obliquely (sloped). The second portion 25 extends in the screw-in direction, i.e., in the clockwise direction (for conventional screws), from a radial outer end of the adjacent first portion 24 to the radially inner end of the next adjacent first portion 24.

As illustrated in FIG. 2, the connector 7, via its hexagonal portion 14, and consequently the retaining washer 16, connected fixedly in terms of rotation to the connector 7, can easily be screwed into the tank 2 in the clockwise direction. The fingers 19 bearing on the toothing 22 slide along on the second portions 25 and are deflected radially inward, i.e., in the direction of the arrow 21 (FIG. 3). The connector 7 is screwed-in until the desired tightening torque is reached. In this position, the connector 7 is secured from rotation by the fingers 19 engaging the first portions 24 of the toothing 22.

The diameter formed by the fingers 19 of the retaining washer 16 is selected to be equal to or greater than that of the base circle 26 of the toothing 22. The base circle corresponds to the radial inner circle of the collar 6. The engagement of the fingers 16 behind the saw-tooth-shaped toothing 22 achieves a locking effect, which prevents the retaining washer 16 from being unscrewed undesirably, i.e., rotating in the counterclockwise direction, and consequently the connector 7 from being unscrewed.

The fingers 19 can be distributed uniformly over the circumference. Alternatively, as illustrated in FIG. 3, they can be set at different angles to one another. In the exemplary embodiment shown, the angle a is preferably set equal to 57° and the angle $\alpha$ is equal to 63°. Thus, the angular spacing between any three adjacent fingers is always 120° and the (middle) finger arranged between the other two fingers is offset at 3° relative to the bisector. If the toothing 22 has, for example, 60 teeth, then the above-described offset of adjacent fingers 19 has the essential advantage in that three fingers 19 mesh with the toothing 22 every 3°. A finer setting of the tightening torque can be achieved by providing more teeth.

In an exemplary embodiment, the retaining washer 16 may be integrally formed with the connector 7. That is, the connector 7 may be provided with corresponding fingers 19 on the circumference of its collar 13. The advantage of a separate retaining washer 16, however, is that any damaged washer 16, which preferably is fabricated from plastic, can be replaced after the connector is intentionally unscrewed. During intentional removal, the fingers 19 can be damaged (forceful removal). By making the washer separable from the connector, the damaged washer can be replaced with a new one.

The present heat exchanger thus advantageously prevents the threaded-type connector from loosening, such as due to vibration, typically encountered in the conventional threaded-type connection. This is accomplished by arranging the retaining washer between the outer surface of the heat exchanger and the connector. More specifically, the connector can have the peripheral collar that bears on the outer surface of the heat exchanger by screwing into the corresponding holding element of the heat exchanger. The retaining washer is arranged between the outer surface of the heat exchanger and the peripheral collar of the connector.

The retaining washer can be connected fixedly in terms of rotation to the connector. The retaining washer has first projections that perform a locking action counter to the screw-in direction of the connector. The outer surface of the heat exchanger is provided in the bearing region of the retaining washer with second projections, which, together with the first projections, perform the locking action.

The heat exchanger according to the invention may be either a water/air heat exchanger, an oil/air heat exchanger, or a water/oil/air heat exchanger. Particularly in the case of the last-mentioned type of heat exchangers, the inlet connector and outlet connector are of two-part design and are screwed into the heat exchanger. To connect inflow and outflow lines, for example, for hot engine oil or transmission oil, the connectors have a connecting thread, onto which the oil hose is screwed by means of a union nut. To prevent the screwed-in connector from being released when the union nut is being unscrewed, the connector according to the invention is secured with the retaining washer. Since this retaining washer is connected fixedly in terms of rotation to the connector, when the connector is being screwed into the heat exchanger, the retaining washer is rotated together with the connector, in the screw-in direction (in the clockwise direction).

This retaining washer has first projections that are inactive when the connector is being screwed into the heat exchanger. But when the connector is rotated counter to its direction of screw-in rotation, the retaining washer, which is connected fixedly to the connector in terms of rotation, prevents the counter-rotation. That is, the first projections display their locking action by cooperating with the second projections, which are provided on the outer surface of the heat exchanger or the annular collar, in the bearing region of the retaining washer. In particular, the first projections engage with the second projections in a claw-like manner. The connector is thereby prevented from being unscrewed unintentionally from the heat exchanger.

In a preferred development, the collar of the connector has a hexagonal portion, and the retaining washer has a complementary hexagonal recess with a bearing face that engages behind the hexagon. The bearing face ensures that the retaining washer is clamped between the collar of the connector and the outer surface of the heat exchanger, thus ensuring a rotational take-up of the retaining washer by the connector via the hexagonal recess, in which the hexagonal portion of the connector engages.

According to the invention, the first projections are formed by fingers projecting substantially radially and tangentially counter to the screw-in direction. When the connector is being screwed into the heat exchanger, these fingers, which are preferably elastically deflectable in the radial direction, spring back elastically radially inwardly and thereby move back the second projections provided on the outer surface of the heat exchanger. The fingers extend essentially in the direction of a spiral running radially outwardly in the counterclockwise direction. The rigidity of the fingers can be increased by making them relatively short.

According to a preferred exemplary embodiment, the second projections are formed by a toothing. This toothing is preferably saw-tooth shaped. The essential advantage of a saw-tooth shaped toothing is that it can perform a locking function in one direction relative to a component traveling over the toothing, whereas no locking action prevails in the other direction.

In particular, the toothing has first portions, which run essentially radially, and second portions, which, in the screw-in direction, connect in each case two adjacent first portions from their radially outer end to their radially inner end. In this case, the first portions, which run radially, serve as locking portions, on which the first projections bear and by which the first projections are blocked counter to the screw-in direction. The second portions serve for lifting out the first projections when they are led over the toothing in the screw-in direction.

Advantageously, the second projections are provided on the collar surrounding the retaining washer and are integrally formed on the outer surface of the heat exchanger. The fingers are supported on this collar when the connector is being unscrewed and transmit the locking forces to the connector via the hexagon.

In an exemplary embodiment, the projections are distributed uniformly over the circumference. In particular, six first projections are provided on the retaining washer, and an integral multiple of second projections, in particular 66 second projections, are provided on the outer surface of the heat exchanger. In this way, the connectors are locked uniformly over their circumference. When the necessary tightening torque is reached, the connector is protected from being unscrewed.

In an advantageous simple yet embodiment, the connector and the retaining washer can be made in one piece, or the retaining washer can be integrally formed with the connector. In that embodiment, no additional component is needed, while achieving the same reliability against the connector being unscrewed.

The disclosure of the German priority application, DE 196 52 639.6, filed Dec. 18, 1996, is incorporated herein by reference in its entirety, including the drawings, claims, and the specification thereof.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

I claim:

1. A heat exchanger comprising:

a tank having a wall, an opening through the wall, and an annular collar concentric with the opening and extending from an outer surface of the wall;

a retaining washer positioned substantially concentrically within the annular collar and engaging an outer surface of the wall, the retaining washer having an opening;

a connector having a threaded portion inserted through the opening of the retaining washer and the opening of the wall, the connector being connected to the retaining washer so that the connector does not rotate relative to the retaining washer;

a nut receiving the threaded portion and the connector being secured to the wall by rotating the connector in one direction, wherein the retaining washer has first projections and the annular collar has second projections, the first projections engaging the second projections, and wherein the first and second projections are arranged to permit the retaining washer to rotate in the one direction and prevent unintentional rotation in the opposite direction.

2. The heat exchanger of claim 1, wherein the connector has a peripheral collar with a hexagonal geometry and the retaining washer has a complementary hexagonal recess engaging the hexagonal collar to provide a non-rotational connection between the connector and the retaining washer.

3. The heat exchanger of claim 1, wherein each first projection is formed by a finger extending outwardly at an angle toward the opposite direction, the finger being elastically deflectable in the radial direction.

4. The heat exchanger of claim 1, wherein the first projections are formed by fingers projecting outwardly, radially and tangentially, toward the unscrewing direction.

5. The heat exchanger of claim 4, wherein the fingers are elastically deflectable in the radial direction.

6. The heat exchanger of claim 1, wherein the second projections are saw-tooth shaped.

7. The heat exchanger of claim 1, wherein each of the second projections has a radially extending portion and a sloped portion, each sloped portion connecting two adjacent radially extending portions, from a radial outer end to a radial inner end.

8. The heat exchanger of claim 1, wherein the second projections are spaced evenly around the annular collar.

9. The heat exchanger of claim 1, wherein the first projections are divided into two groups, one projection of one group being positioned alternatingly between two projections of the other group, and wherein the angular spacing between the first projections within the group relative to the first projections of the other group are identical and an angular spacing between one projection and one of the two projections adjacent thereto and an angular spacing between the one projection and the other of the two projections adjacent thereto are different.

10. The heat exchanger of claim 1, wherein the diameter formed by the first projections is greater than or equal to the diameter formed by a base circle of the second projections.

11. The heat exchanger of claim 1, wherein the connector has a circumferential groove into which the retaining washer is engaged.

12. The heat exchanger of claim 1, wherein the nut is positioned inside the tank.

13. The heat exchanger of claim 12, wherein the nut is non-rotatably positioned in the tank.

14. The heat exchanger of claim 13, wherein the nut has an annular groove and an O-ring is seated in the annular groove to provide a seal between the wall and the nut.

15. The heat exchanger of claim 14, further including another O-ring provided between the connector and the nut, in the region of the opening.

* * * * *